US007350523B1

(12) United States Patent
Erickson

(10) Patent No.: US 7,350,523 B1
(45) Date of Patent: Apr. 1, 2008

(54) TOBACCO SMOKING PIPE

(76) Inventor: Kenneth Alan Erickson, 6631 E. Paseo San Andres, Tucson, AZ (US) 85710

( * ) Notice: Subject to any disclaimer, the term of this patent is extended or adjusted under 35 U.S.C. 154(b) by 627 days.

(21) Appl. No.: 10/762,923

(22) Filed: Jan. 22, 2004

Related U.S. Application Data

(63) Continuation of application No. 10/159,501, filed on May 31, 2002, now abandoned.

(51) Int. Cl.
*A24F 1/00* (2006.01)

(52) U.S. Cl. ..... 131/222; 131/226

(58) Field of Classification Search ..... 131/330, 131/175, 180, 187, 191, 190, 226, 222
See application file for complete search history.

(56) References Cited

U.S. PATENT DOCUMENTS

| | | | | |
|---|---|---|---|---|
| 34,585 | A | 3/1862 | Milne | 131/198.2 |
| 140,360 | A | 7/1873 | Gedies | 131/198.1 |
| 711,691 | A | 10/1902 | Barger | 131/198.1 |
| 882,825 | A | 3/1908 | Heald | 131/198 |
| 959,043 | A | 5/1910 | Barger | 131/198.2 |
| 1,272,389 | A | 7/1918 | Cooper | 131/198.1 |
| 1,388,733 | A | 8/1921 | McGuckin | 131/198.1 |
| 2,124,130 | A | 7/1938 | Van Deventer | 131/198.2 |
| 3,270,751 | A | 9/1966 | Tucker | 131/198 |
| 3,713,452 | A | 1/1973 | D'Elia et al. | 131/198 A |
| 4,080,972 | A | 3/1978 | Furlow | 131/180 |
| 4,116,204 | A | 9/1978 | Kline | 131/173 |
| 4,135,522 | A | 1/1979 | Hendricks | 131/198 R |
| 4,151,849 | A * | 5/1979 | Beck | 131/180 |
| 4,214,658 | A | 7/1980 | Crow | 131/244 |
| 4,328,795 | A | 5/1982 | Cabaniss, III | 131/180 |
| 4,596,258 | A | 6/1986 | Steiner | 131/198.1 |
| 4,788,988 | A | 12/1988 | Titus | 131/198.2 |
| 5,417,227 | A | 5/1995 | West | 131/185 |
| 5,819,756 | A | 10/1998 | Mielordt | 131/330 |
| 6,196,232 | B1 | 3/2001 | Chkadua | 131/222 |
| 6,260,554 | B1 | 7/2001 | Rowland et al. | 131/181 |

* cited by examiner

*Primary Examiner*—Carlos Lopez

(57) ABSTRACT

A cigar shaped tobacco smoking pipe having a draw piece (14) with a band (12) adapted by proper sizing or screw thread to receive either end of a bowl piece (16). A bore (18) communicates with a smoking cavity (20), a chamber (10), and a draw piece (14). Both ends of the detachable bowl piece (16) are identically adapted, in any number of ways, including by identical tapers or screw threads to insert into the band (12). The pipe may be smoked with pieces assembled either way.

2 Claims, 12 Drawing Sheets

TOBACCO SMOKING PIPE

CROSS-REFERENCE TO RELATED APPLICATIONS

Figure 1A:
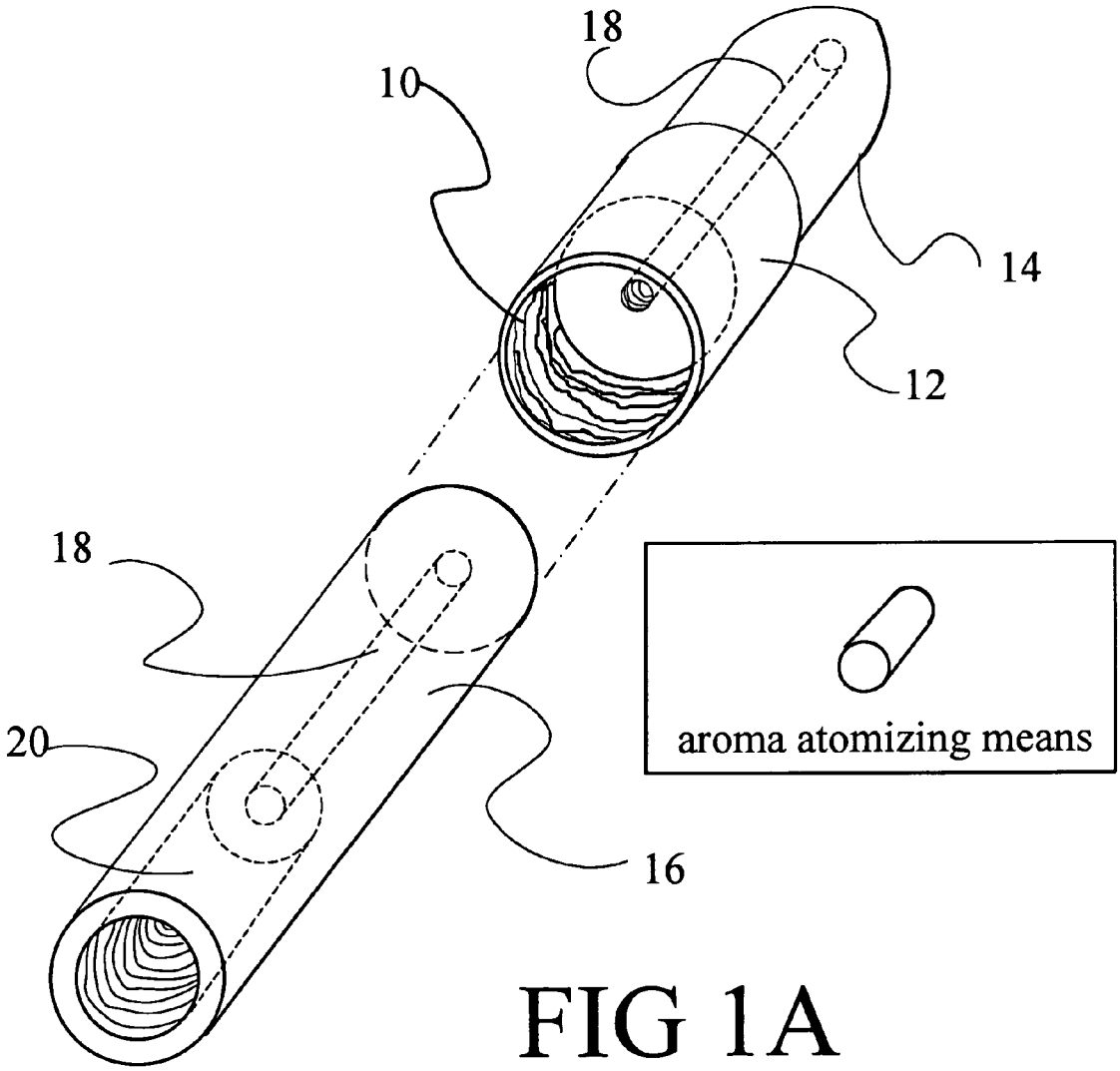

This is a continuation of application Ser. No. 10/159,501, Filed May 31, 2002, now abandoned.

BACKGROUND

1. Field of Invention

This invention relates to tobacco smoking pipes and quit smoking aids.

2. Discussion of Prior Art

All pipes heretofore known to protect the bowl and have storage capacity suffer from one or more of a number of disadvantages:

a) they create an uncomfortable bulge in the pocket
b) (Deleted)
c) they have elaborate devices incorporated to store tobacco
d) (Deleted)
e) they have elaborate ways to prevent debris from spilling
f) (Deleted)
g) they are expensive to manufacture.

There are patents for devices called cigar pipes and smoking tubes that do fit conveniently into trouser pocket, however, these are complicated devices to fill and are a nuts and bolts type of solution to the previous bulky pipe. For example U.S. Pat. No. 4,788,988 to Titus (1988) is a very complicated device to use and expensive to manufacture.

U.S. Pat. No. 6,196,232 to Chkadua (2001) provides a cover for the smoking cavity but when it is rotated to reveal the cavity, it resembles a jagged block. There are other patents in this category like U.S. Pat. No. 4,730,626 to Caulkins (1988) that have many parts to provide a simple cover for the pipe. The U.S. Pat. No. 4,151,849 to Beck (1979) has a bail wire to secure the bowl and allow the bowl to be rotated. This solution creates a bulky pipe, whose parts can catch on clothing and disassemble allowing tobacco and ash to spill into one's pockets. The U.S. Pat. No. 4,286,607 to Claesens (1981) is a tube made entirely of glass not a pleasing material to hold and smoke from, besides being fragile and easy to break upon dropping.

A pipe that allows the user to regulate the mixture of smoke and air is in U.S. Pat. No. 4,596,258 to Steiner (1986). This device has separate passages to open and close, again an extremely complicated device for blending smoke and air. Another even more expensive to produce and complicated to use pipe is U.S. Pat. No. 6,260,554 to Rowland, et al. (2001) that includes adjustable reservoirs, various bores and parts that blend the mixture.

The U.S. Pat. No. 4,214,658 to Crow (1980) is a smoking system that has a container for the storage of tobacco and the pipe. This patent has the disadvantage of having many parts, which can be lost.

SUMMARY

In accordance with the present invention a smoking pipe comprises a cigar-shaped bowl piece with both ends adapted to insert into a band attached to a draw piece. The bowl piece is adapted being generally cigar shaped with congruent tapers at each end so that either end fits tightly into a tubular band sized to receive the bowl piece. In another fashion, each end of the bowl piece may be adapted to connect to the band being congruently threaded. The pipe has a smoking cavity in one end of the bowl piece connected to the bore. Also the pipe has a draw piece with a tubular band attached at one end that is adapted to receive either end of the bowl piece. This draw piece adaptation may be a sized tube that will receive the congruous tapers at each end of the bowl piece creating a snug union of the pieces by wedging either end of the bowl piece into the tube. In addition, the draw piece may have screw threads that screw onto either end of the bowl piece. Disconnecting the bowl piece from the draw piece reveals a chamber between the two ends and enclosed by the band

OBJECTS AND ADVANTAGES

Several objects and advantages of the present invention are:

a) to provide a sleek attractive pipe that looks, lights, and smokes like a cigar;
b) (Deleted)
c) (Deleted)
d) to provide a pipe that fits conveniently into ones pocket;
e) to provide a pipe that has a way to cover and contain the smoking cavity and its contents;
f) to provide a pipe in which one can store tobacco without fear of spillage for smoking at a later time;
g) to provide a pipe in which one can put out the smoldering embers immediately and slip into a pocket without fear of spilling embers;
h) (Deleted)
i) to provide a pipe that does not display the smoking cavity while in use;
j) (Deleted)
k) (Deleted)

Further objects and advantages are to provide a pipe that can be used easily and conveniently to smoke tobacco, which is simple to use and inexpensive to manufacture, which can be used by cigarette smokers, by cigar smokers, and by pipe smokers. It can also be used by those wishing to quit smoking. Still further objects and advantages will become apparent from a consideration of the ensuing description and drawings.

DRAWING FIGURES

In the drawings closely related figures have the same number but different alphabetic suffixes.

FIG. 1A shows a pipe supplied with a band attached to a draw piece. The pipe is viewed in a position for the draw piece to receive one end of a bowl piece. Both ends of the bowl piece are generally congruous. This pipe is equipped with a smoking cavity in one end of the bowl piece. A central bore runs through both pieces.

Figure 1B:
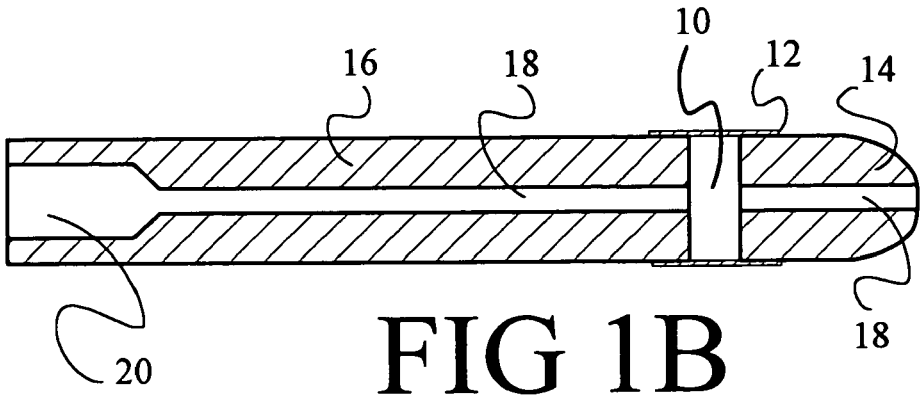
Figure 1C:
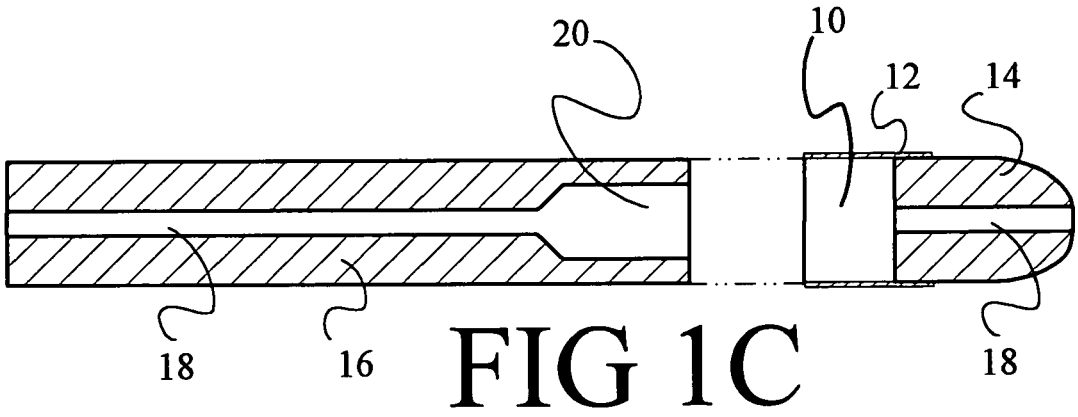
Figure 1D:
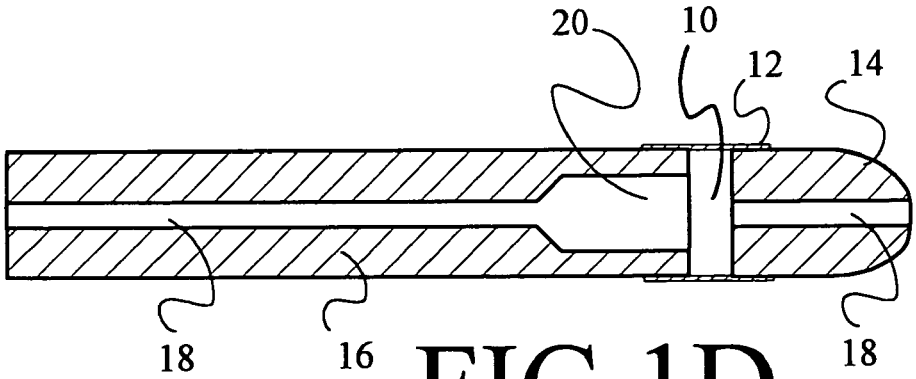

As shown in FIGS. 1B to 1D, both ends of the bowl piece are adapted to receive the band. FIG. 1B shows the band receiving one end of the bowl piece. FIG. 1C shows the alternate position of the bowl piece. FIG. 1D shows band receiving the other end of the bowl piece.

Figure 1E:
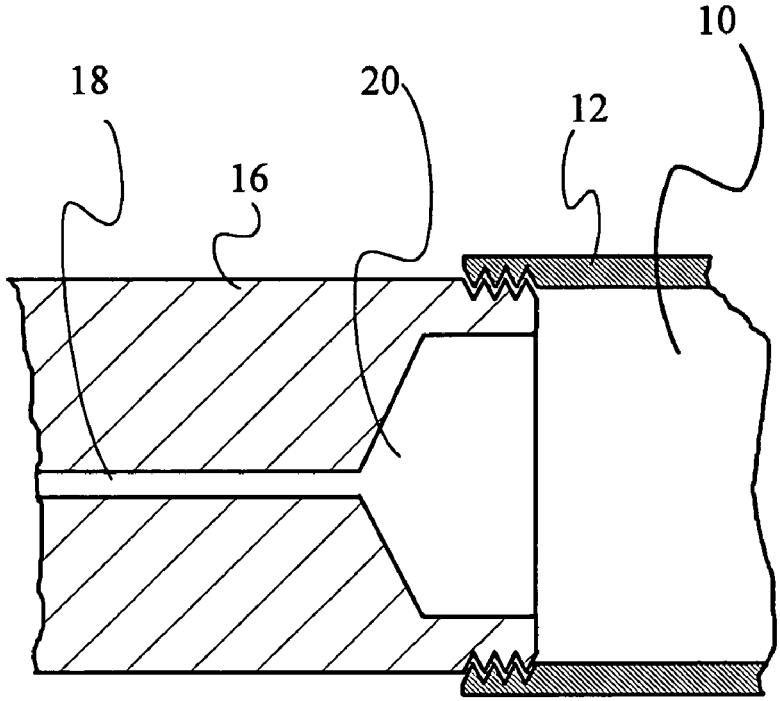
Figure 1F:
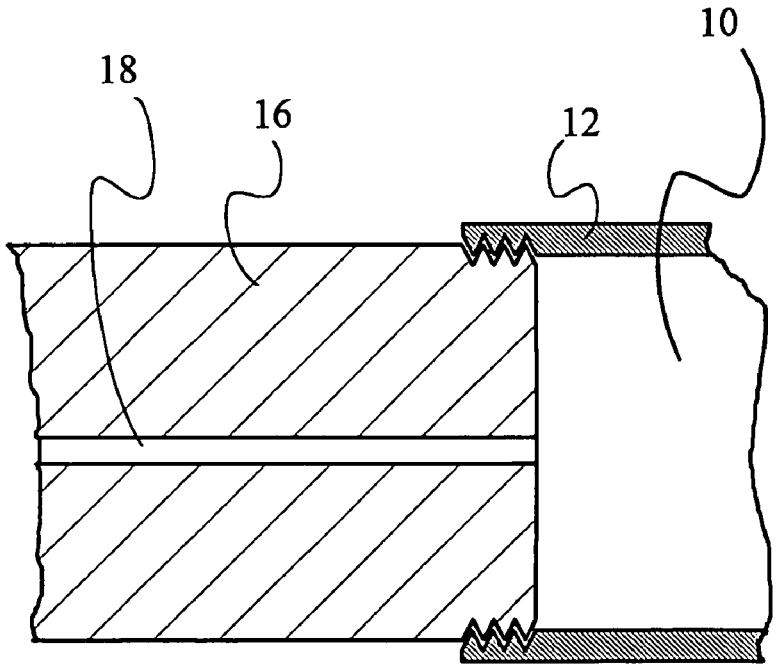

FIGS. 1E & 1F show a detail of one type of adapted connection between the band and the bowl piece of the pipe in FIGS. 1A to 1D. In this connection detailed in FIGS. 1E and 1F, the pieces are adapted by being congruently threaded into each other. FIG. 1E is a detail illustrating a threaded connection between the band and one end of the bowl piece.

FIG. 1F is showing a detail view of the congruently threaded connection of the band to the other end of the bowl piece.

Figure 1G:
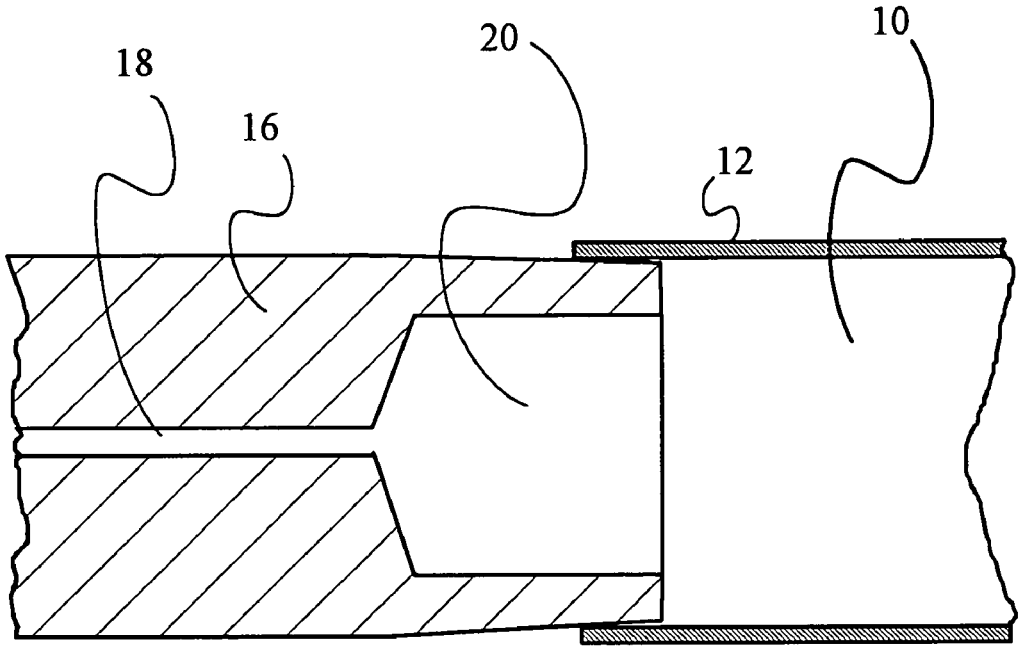
Figure 1H:
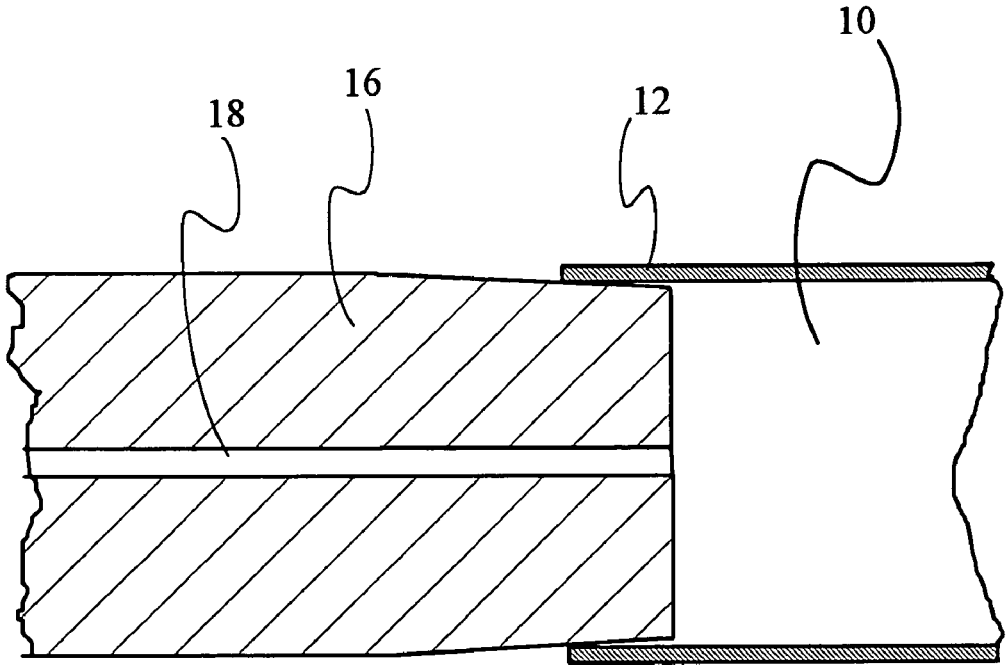

FIGS. 1G & 1H show a detail of another type of connection between the band and the bowl piece of the pipe in FIGS. 1A to 1D. In this connection detailed in FIGS. 1G and 1H, the pieces are adapted with each end of the bowl piece being tapered to conically wedge into the tubular band. FIG. 1G is a detail illustrating this conical wedge connection between the band and the bowl piece. FIG. 1H is a detail view of this conical wedge connection of the other end of the bowl piece.

REFERENCE NUMERALS IN DRAWINGS

10 chamber

12 band

14 draw piece

16 bowl piece

18 bore

20 smoking cavity

Description—FIGS. 1A to 1H—Preferred Embodiment

A preferred embodiment of the pipe is illustrated in FIG. 1A (perspective view), FIGS. 1B to 1D (longitudinal sections), and FIGS. 1E to 1H (detail sections of the draw piece to bowl piece union). The pipe has a draw piece 14 and a bowl piece 16, which has a smoking cavity 20. In the preferred embodiment a brass band 12 nearly 5 cm long and about 0.5 mm thick is attached to one end of a draw piece 14 of a cylindrical black-walnut pipe. However, the pipe can have any number of cross-sectional shapes as long as both ends of the bowl piece 16 are adapted to insert into the band 12. In conjunction, band 12 is adapted to accept either end of the bowl piece 16. The pipe is easily machined or fashioned using existing manufacturing processes.

The bowl piece 16 has a through bore 18. There is a chamber 10 formed within the band 12. There is a through bore 18 in the draw piece 14. By unscrewing FIGS. 1E & 1F or unwedging FIGS. 1G & 1H the bowl piece 16 from the draw piece 14 one accesses this chamber 10 between the draw piece 14 and the bowl piece 16. This chamber 10 may be used to store extra tobacco or house a filter. Boring can form the bore 18 and the smoking cavity 20. The pipe is typically 1 cm to 2.5 cm across and 8 cm to 15 cm in length and one end of the draw piece 14 of the pipe is typically rounded and smooth.

The pipe has the band 12 fixed to the draw piece 14 and, as shown in FIGS. 1E through 1H, the band 12 is adapted to receive either end of the bowl piece 16. This allows the bowl piece 16 to be removed from the draw piece 14 by unscrewing FIGS. 1E & 1F or unwedging FIGS. 1G & 1H, flipped and re-positioned into the band 12 thus protecting and sealing the end smoking cavity 20. The bowl piece 16 therefore having both ends adapted to insert into the band 12.

FIGS. 2A-3H—Additional Embodiments

Figure 2A:
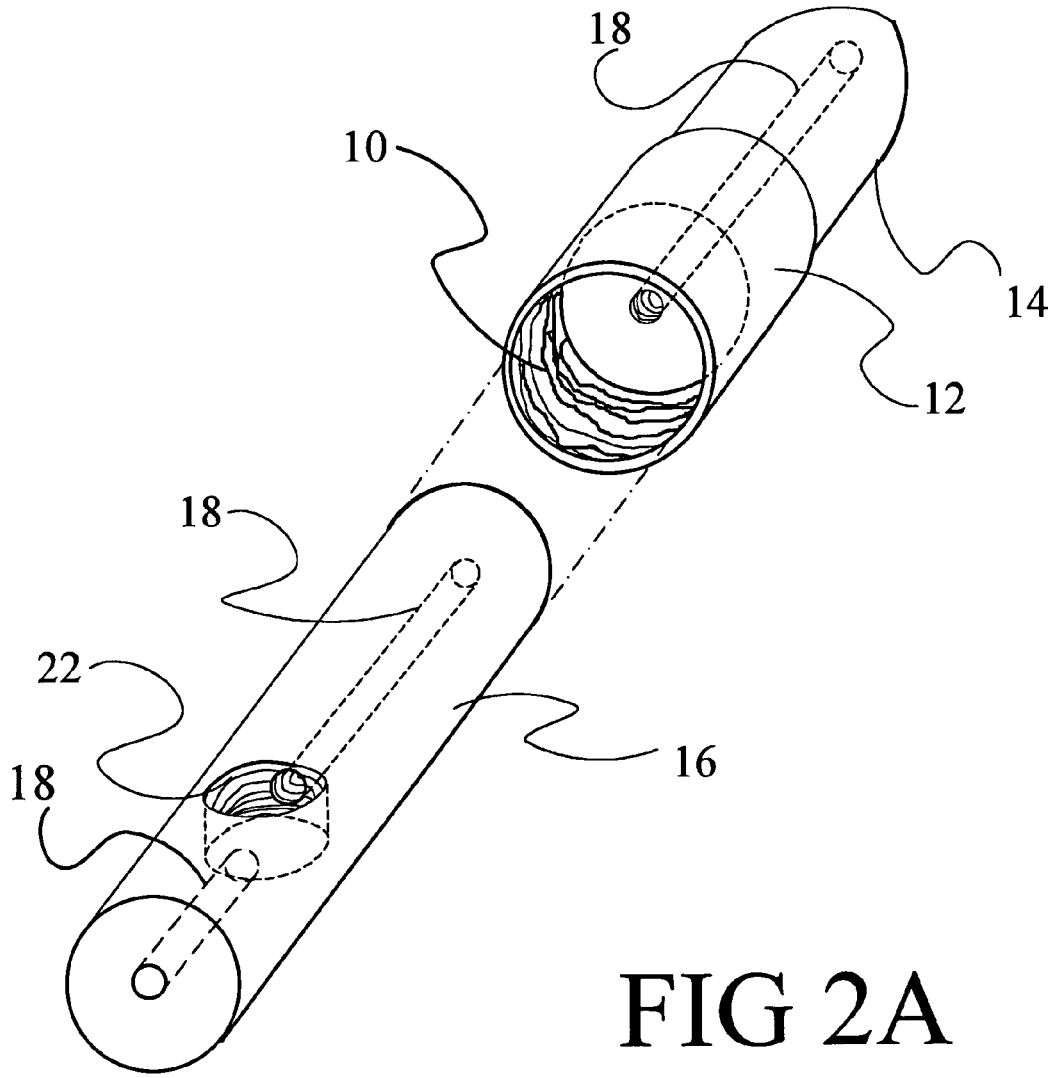
Figure 2B:
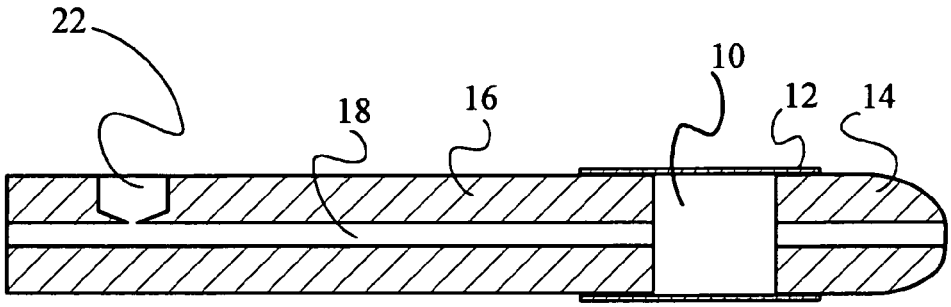
Figure 2C:
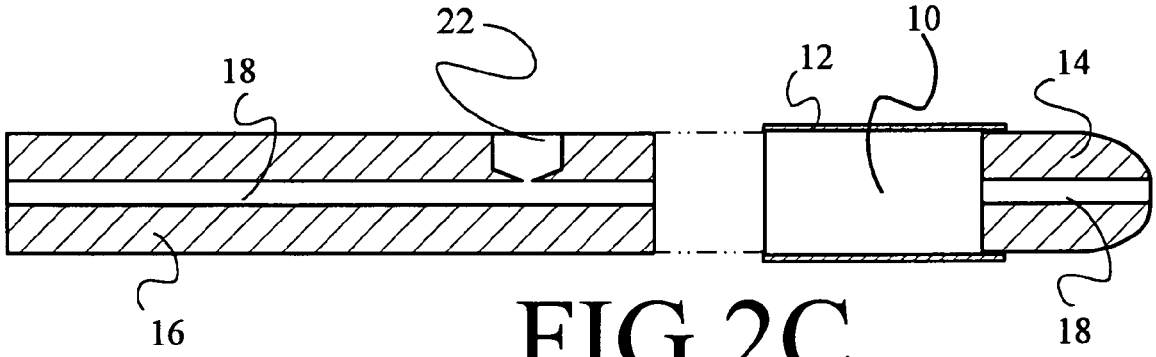
Figure 2D:
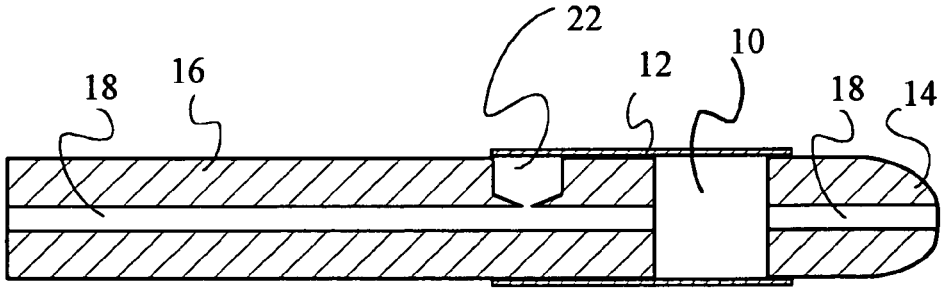
Figure 2E:
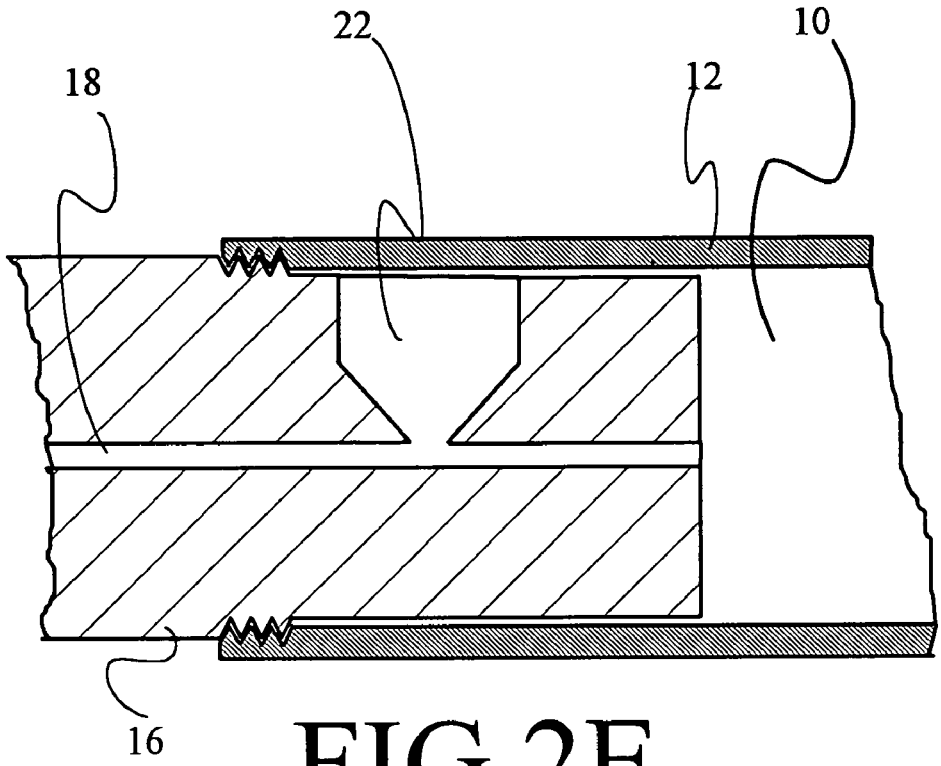
Figure 2F:
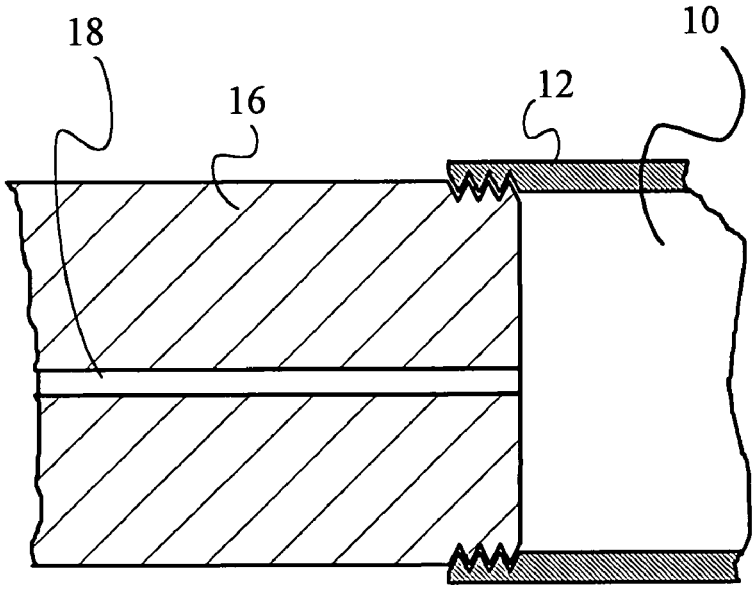
Figure 2G:
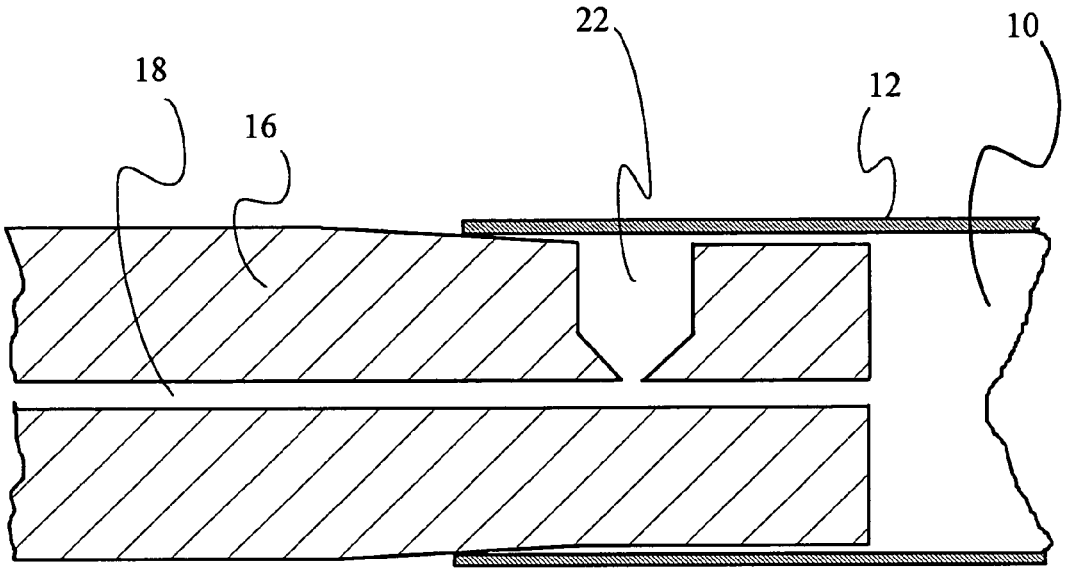
Figure 2H:
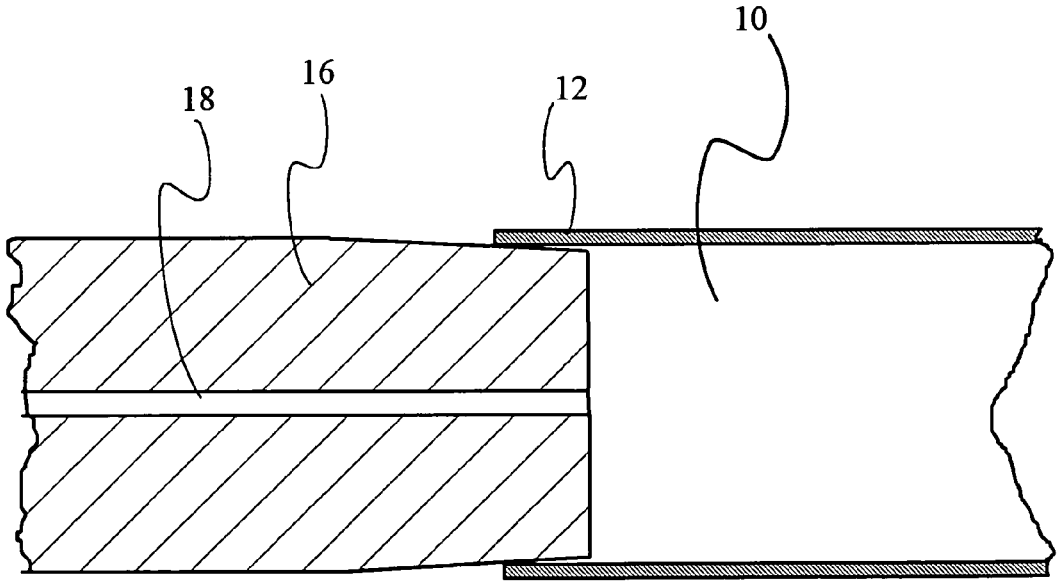
Figure 3A:
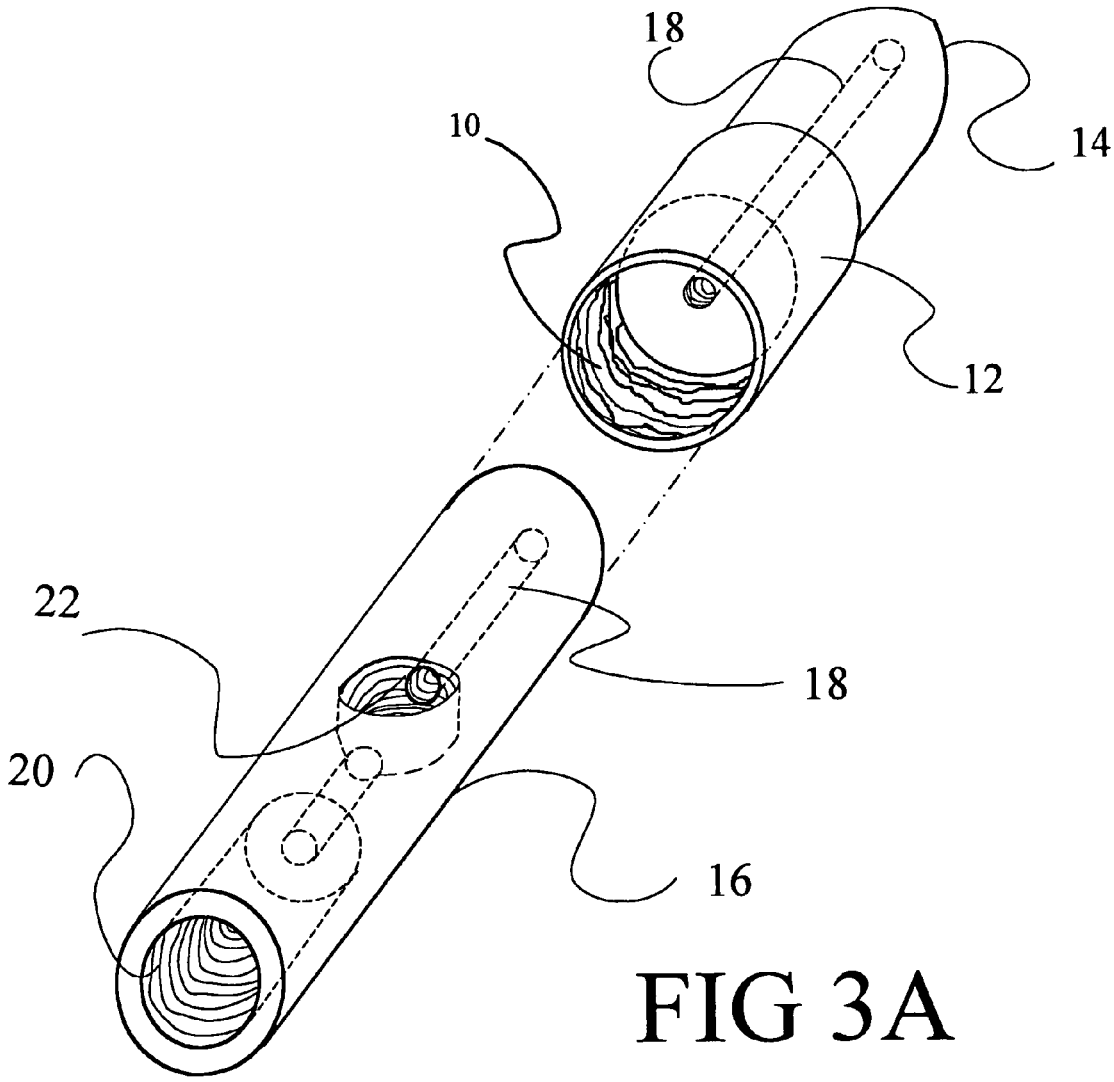
Figure 3B:
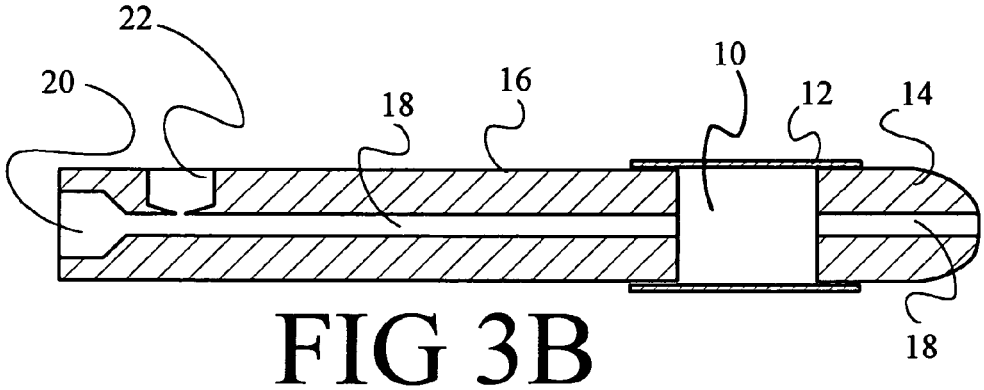
Figure 3C:
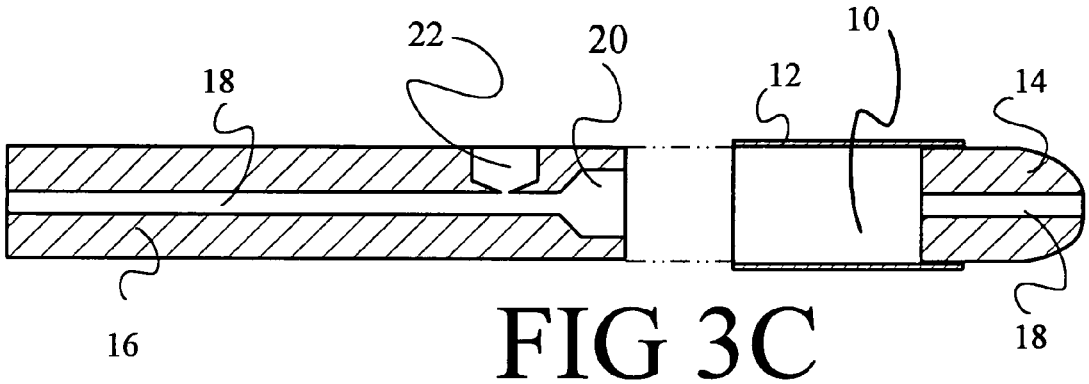
Figure 3D:
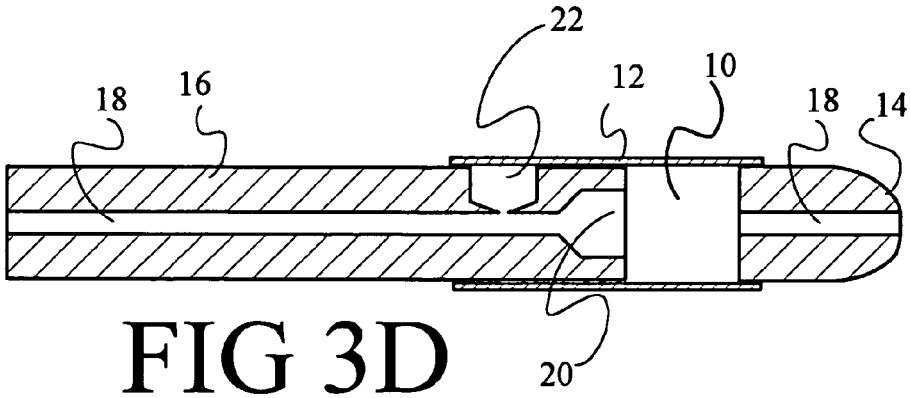
Figure 3E:
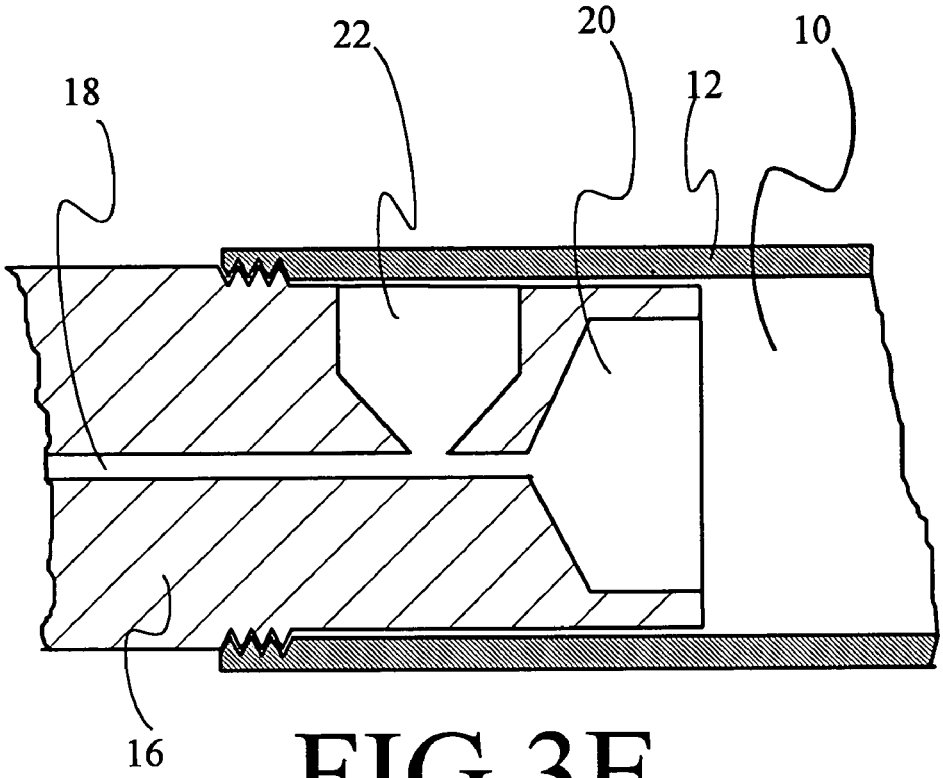
Figure 3F:
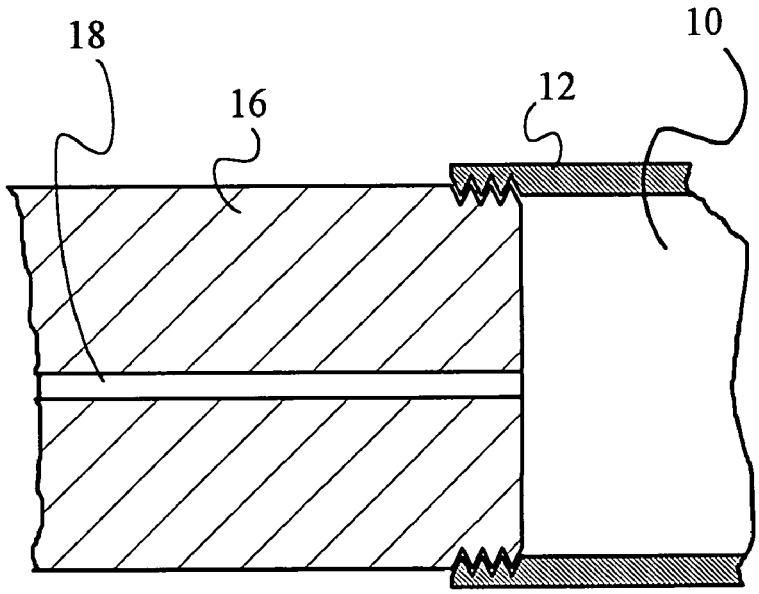
Figure 3G:
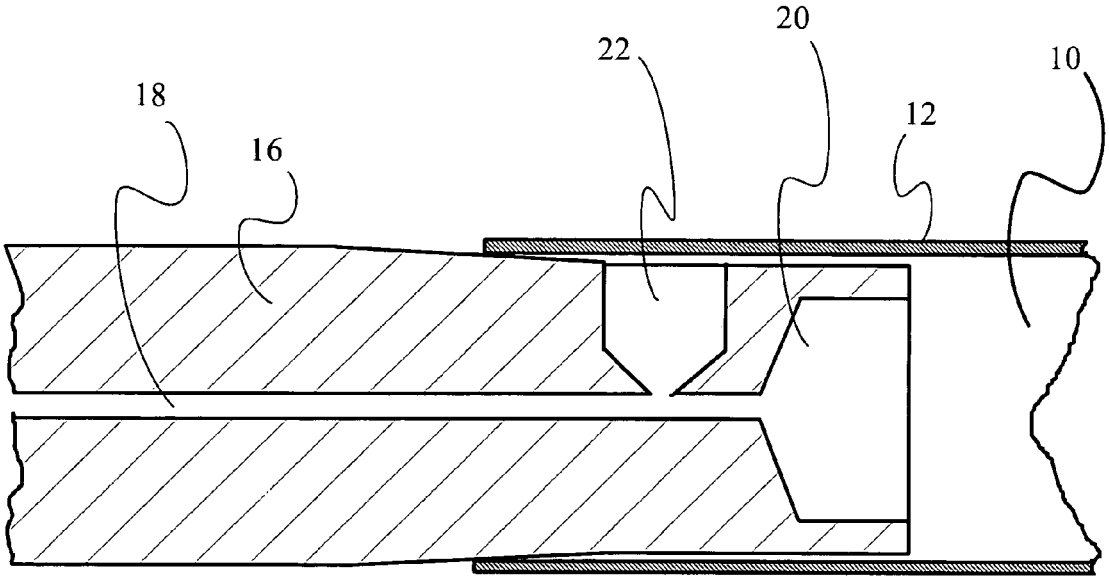
Figure 3H:
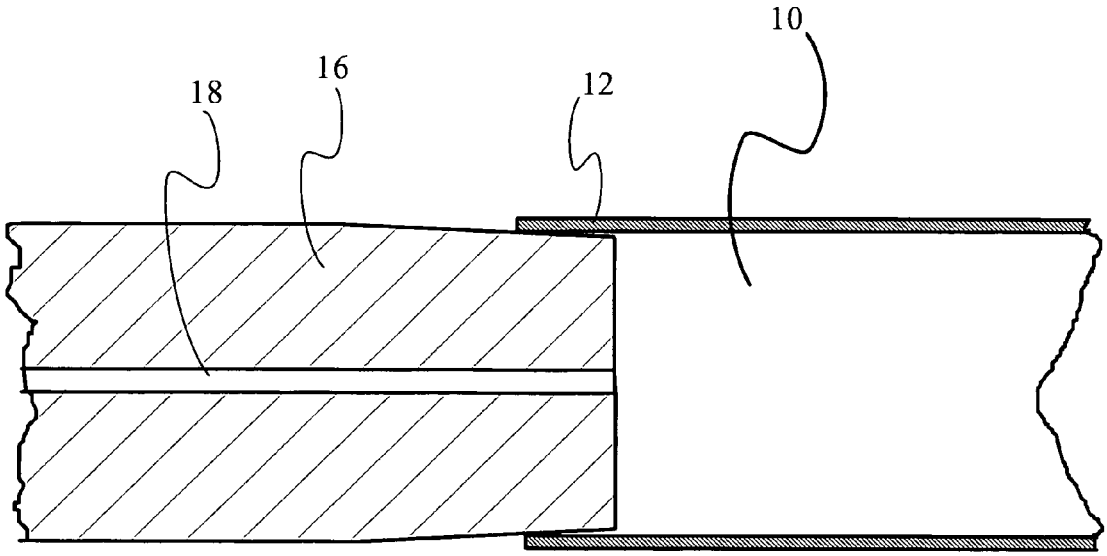

Additional embodiments are shown in FIG. 2A (perspective view), FIGS. 2B to 2D (longitudinal sections), FIGS. 2E to 2H (detail sections of the draw piece to bowl piece union), FIG. 3A (perspective view), FIGS. 3B to 3D (longitudinal sections), and FIGS. 3E to 3H (detail sections of the draw piece to bowl piece union).

Advantages

From the above description, a number of advantages of my pipe become evident:

a) it provides the smoker a sleek attractive pipe that looks, lights, and smokes like a cigar;

b) (Deleted)

c) the smoker can travel with the pipe in a conventional cigar case or conveniently into ones pocket;

d) one can store tobacco without fear of spillage and one can put out the smoldering embers immediately and slip into a pocket without fear of spilling embers;

e) (Deleted)

f) the smoker does not have to view the smoking cavity while in use;

g) (Deleted)

Further objects and advantages are to provide a pipe that can be used easily and conveniently to smoke tobacco. It is simple to use and inexpensive to manufacture. The pipe can be used by cigarette smokers, by cigar smokers, and by pipe smokers to smoke or to aid them in quitting tobacco. Still further objects and advantages will become apparent from a consideration of the ensuing description and drawings.

Operation-Preferred Embodiment—FIGS. 1A to 1H

The manner of using my pipe is that one first lights, the tobacco in smoking cavity 20 of bowl piece 16 and inhales the smoke through bore 18 from draw piece 14. Next, one taps out the ash, reinserts bowl piece 16 into band 12. One may then slip this pipe into a cigar case, shirt pocket or into a conventional ashtray without fear of spillage. Or rather, the smoker may refill cavity 20 and travel with the pipe full of tobacco with no spillage. When ready to smoke, simply light.

CONCLUSION, RAMIFICATIONS AND SCOPE

Thus, the reader will see that the "cigar O rama" smoking pipe can be smoked easily and conveniently, can be extinguished just as easily, and can also be used to carry extra tobacco, eliminating the need for a separate container for the tobacco. The pleasing cigar shape and appearance make it an ideal placebo or prop for one to use in conjunction with aromatherapy when they do not wish to smoke and desire to quit tobacco. The ability to flip the bowl piece allows this pipe to travel well and to never be messy as the smoker has the ability to easily cover or reveal the smoking cavity. This feature also allows one to slip the pipe into a pocket without fear of spilling on or burning their clothing, also the odor and unsightliness of the smoking chamber is concealed. No special cases are required for this pipe but is so desired, it can be used with conventional cigar cases. This pipe is very easy and inexpensive to manufacture and can be fashioned from common and readily available components. Many embodiments of the pipe are possible that include other methods of adapting the congruent ends of the bowl piece to receive the draw piece.

The invention claimed is:

1. A cigar shaped smoking pipe having a draw piece and a bowl piece being adapted to fit together, a round band attached to the draw piece, a smoking cavity bored into said bowl piece, a storage chamber surrounded by said band and formed between said pieces when fit together, and a bore drilled through said draw piece and said bowl piece communicating with said smoking cavity and with said storage chamber and adapted to communicate to the smoker wherein the invention comprises:

a) both ends of said bowl piece having congruent tapers, both ends being adapted so either end may insert into said band;

b) said band is a tube of an inside diameter sized to receive either end of said bowl piece whereby a snug connection is quickly achieved;

c) said band and said bowl piece being assembled together by simple pressure and held together by friction and being able to separate easily by wiggling.

2. The pipe of claim 1 wherein the invention comprises:

a) both ends of said bowl piece having screw threads, both ends being adapted so either end may insert into said band;

b) said band is a tube of an inside diameter threaded to receive either end of said bowl piece whereby a snug connection is quickly achieved;

c) said band and said bowl piece being assembled together by screwing and being able to separate easily by unscrewing.

* * * * *